US011504827B2

(12) United States Patent
Esmail et al.

(10) Patent No.: US 11,504,827 B2
(45) Date of Patent: Nov. 22, 2022

(54) ADJUSTABLE BOX WRENCH

(71) Applicant: Invaluable Inventions, Mountain View, CA (US)

(72) Inventors: Kemaal Akber Esmail, Mountain View, CA (US); Robert Fullerton, Morgan Hill, CA (US)

(73) Assignee: Invaluable Inventions, Mountain View, CA (US)

( * ) Notice: Subject to any disclaimer, the term of this patent is extended or adjusted under 35 U.S.C. 154(b) by 286 days.

(21) Appl. No.: 16/666,040

(22) Filed: Oct. 28, 2019

(65) Prior Publication Data

US 2021/0008696 A1 Jan. 14, 2021

Related U.S. Application Data

(60) Provisional application No. 62/873,030, filed on Jul. 11, 2019.

(51) Int. Cl.
*B25B 13/52* (2006.01)

(52) U.S. Cl.
CPC ..... *B25B 13/52* (2013.01)

(58) Field of Classification Search
CPC ..... B25B 13/52; B25B 13/56; B25B 13/14; B25B 27/0071; B25B 13/005; B25B 13/04; B25B 13/462; B25B 13/467; B25B 13/48; B25B 13/481; B25B 13/54; B25B 15/001; B25B 17/00; B25B 21/00; F16C 33/08
See application file for complete search history.

(56) References Cited

U.S. PATENT DOCUMENTS

| | | | | |
|---|---|---|---|---|
| 2,290,197 A * | 7/1942 | Merriman | B25B 13/467 | 81/57.46 |
| 4,224,844 A * | 9/1980 | Henriksen | B25B 13/467 | 81/57.46 |
| 4,656,894 A * | 4/1987 | Goetz | B25B 13/00 | 81/57.43 |
| 5,768,957 A * | 6/1998 | Baker | B25B 13/467 | 74/105 |
| 2011/0000342 A1* | 1/2011 | Lambert | B25B 17/00 | 81/57 |
| 2013/0032007 A1* | 2/2013 | Chen | B25B 13/481 | 81/57.32 |

* cited by examiner

*Primary Examiner* — Robert J Scruggs
(74) *Attorney, Agent, or Firm* — Mark Penfold

(57) ABSTRACT

The invention comprises an adjustable box wrench that can provide a more accurate grasp and/or sufficient grip/contact with the faces of the head of a bolt, nut, and/or similarly related objects. The invention comprises a series of pins and links which form a loop within a hollow body and are folded onto each other to form a tight gripping surface at the wrench's box ends. The invention may also contain slide-switches and/or scroll knobs to help actuate link closure or guide links within the chamber of the body until the desired set of links is within a box end.

7 Claims, 11 Drawing Sheets

ADJUSTABLE BOX WRENCH

CROSS-REFERENCES TO RELATED APPLICATIONS

The instant application claims priority from provisional application No. 62/873,030, filed Jul. 11, 2019, the disclosure of which is incorporated by reference herein in its entirety.

FIELD OF THE INVENTION

The invention relates generally to hand tools and wrenches. More specifically, the invention is a box wrench tool with adjustable box ends.

BACKGROUND OF THE INVENTION

People have long relied on hand tools to make daily life more efficient and comfortable. A key example of a modern tool is the wrench, and these come in many varieties including the class of box wrenches. Box wrenches are often useful for being able to enclose around or firmly gripping around the heads of a bolt, nut, or other similarly related object. However, most box wrenches are not adjustable; meaning, most box wrenches can not be used on multiple different sizes and/or shapes of bolts or nuts. There are some adjustable box wrenches available but these often do not provide sufficient contact or grip around all side faces of the head of the bolt or nut, as they utilize a sliding member to change the inner diameter or area of the gripping box end.

An objective of the invention is to provide users with an improved adjustable box wrench. The invention intends to provide users with an adjustable box wrench that can provide a more accurate grasp and/or sufficient grip/contact with all faces of the head of a bolt, nut, and/or similarly related objects. The invention intends to provide users with a device that can be made adjustable to fit with a wide variety of standard and non-standard sizes of nuts or bolts in order to minimize the guesswork involved to acquire the correct tightness needed to use said device on a head of a bolt or nut.

SUMMARY OF THE INVENTION

The invention contains an adjustable box wrench with a hollow body. The hollow body is often similar in shape to most common box wrenches. The body usually contains either a single box end or two opposing box ends, but some embodiments contain multiple box ends with various placements. The hollow body contains a track along the inner surfaces of both the top and bottom faces of the chamber, although in some embodiments only a single track may be required and may have different positioning. The invention further contains a plurality of sets of links; in which each link within a set of links are similarly sized to one another while each set of links can differ from other sets of links in shape and/or size. Although each link within a set of links is connected to one another by a pin, the last two links within a set of links are connected together by a spring-loaded pin. Additionally, each set of links is detached from each other. The plurality of sets of links rest within the chamber of the body and are guided through/within the body by the pins, whose protruding ends are resting between the two tracks of the body. The invention may additionally contain a switch that can force the last link of a set of links to close inward across the body towards the first link of that set of links when that set of links is located within a box end of the invention in order to form an interface in a shape such that a bolt or nut could be secured within said interface of a box end. The invention can additionally contain a scroll knob to help guide the plurality of sets of links around within the chamber of the body until the desired set of links is within a box end of the invention.

BRIEF DESCRIPTION OF THE DRAWINGS

The following drawings are offered to illustrate, but not to limit the claimed invention, and none of the limitations implied should be construed as limiting on the claims.

DESCRIPTION OF EMBODIMENTS

Figure 1:
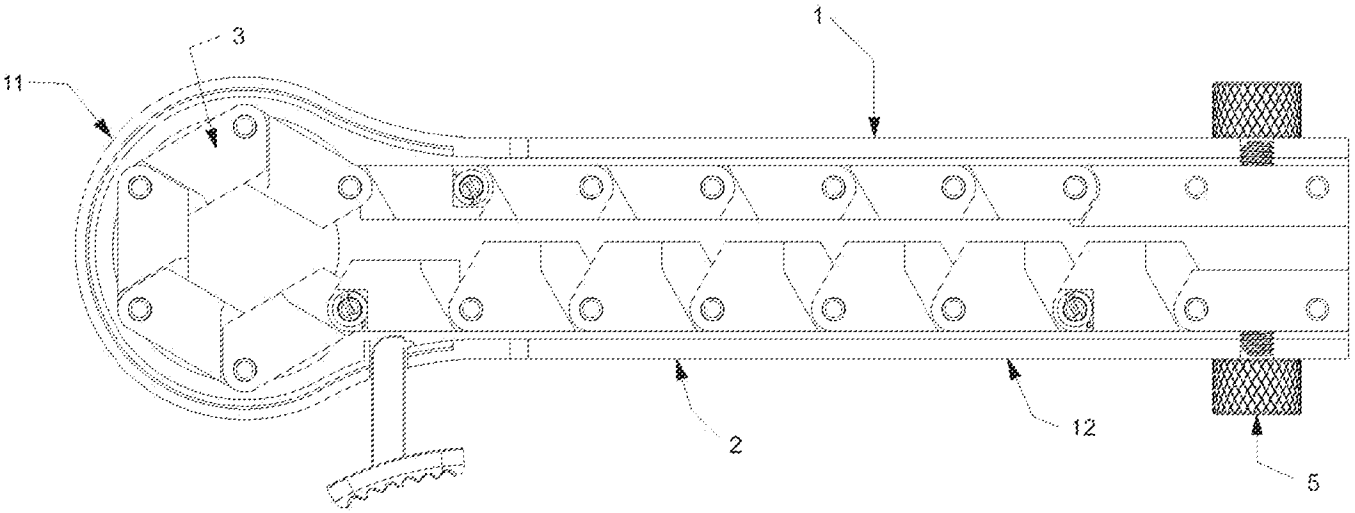
FIG. 1 is a cross-sectional, top plane view of a box end of a first embodiment of the invention with the plurality of sets of links undetached from one another.

It is understood that the figures, examples and embodiments described herein are for illustrative purposes only and that various modifications or changes in light thereof will be suggested to persons skilled in the art and are to be included within the spirit and purview of this application and scope of the appended claims. The following examples are offered to illustrate, but not to limit the claimed invention, and none of the limitations implied in the example embodiments should be construed as limiting on the claims. All drawings and embodiments shown represent selected versions of the invention and are not intended to limit the scope of the invention. All references of user or users pertain to either individual or individuals who would utilize the invention.

The exact choice or combination of materials employed in the construction of the invention depends on the specific application and embodiment. In any case, suitable materials are known, or will become known, to those skilled in the art, and their exclusion from this text is not intended to detract from their importance in this invention. However, it can be preferred that the invention be of a material that is strong, durable, tough, easily manufacturable, impact-resistant, shatter-proof, lightweight, and/or weather-resistant. Such materials can include metals like iron and such, plastics like acrylics, and/or other similarly relevant materials.

It can be preferred the invention be of a general shape similar to the general shape of most common or conventional wrenches; in particular, a double-ended box wrench. Although, it should be understood by those well-versed in the art that the invention can be of other shapes while still fulfilling the objects and intents of the invention, and examples are provided. It can be preferred that the invention be of a general size such that the invention can be grasped and/or handled by the hands of an average adult user.

Example 1

The first example is illustrated by FIG. 1 through FIG. 5. As seen in FIG. 1 through FIG. 4, a first embodiment of the invention provides an adjustable box wrench (1), primarily including a body (2), a plurality of sets of links (3) and accompanying pins (4), one or more scroll knobs (5) and accompanying slits (6), one or more slide-switches (7) and accompanying channels (8). The invention can be of any shape, size, material, features, type or kind, orientation, location, quantity, components, and arrangements of components that would allow it to fulfill the objectives and intents of the invention.

Figure 4:
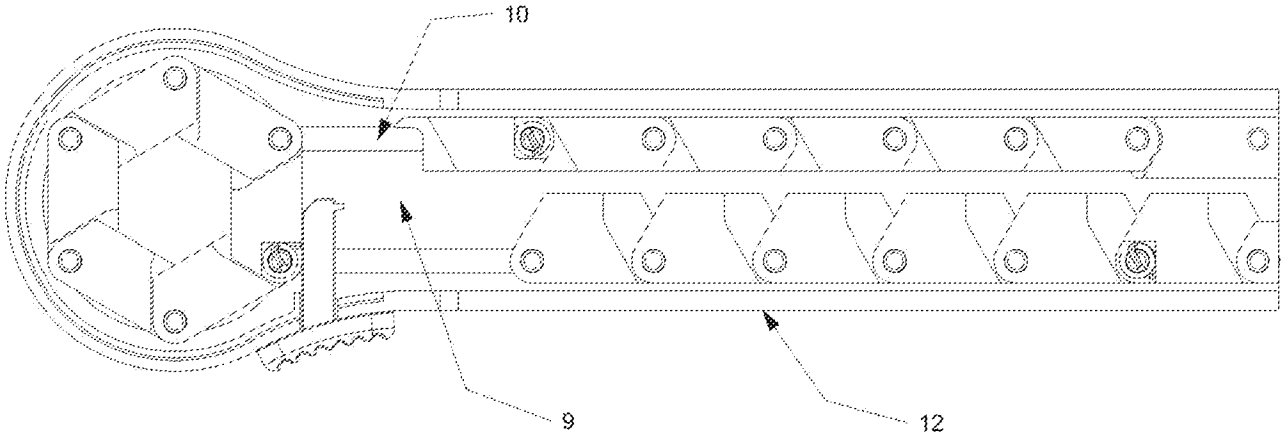
FIG. 4 is a cross-sectional, top plane view of a box end of a first embodiment of the invention with a set of links interlocked in the closed position to form a shape such that could interface with another object.
Figure 5:
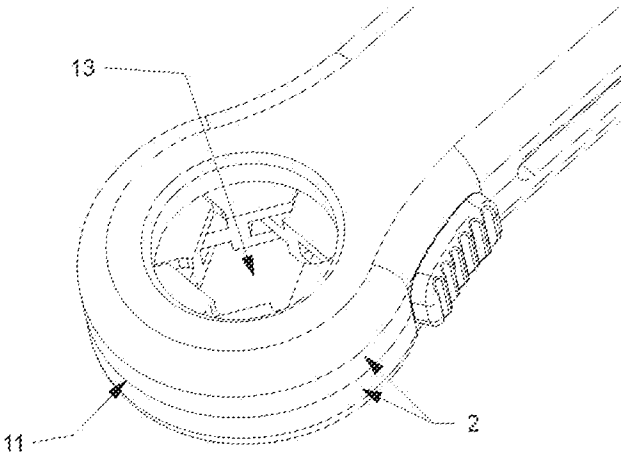
FIG. 5 is a close-up perspective view of a box end of a first embodiment of the invention.

As seen in FIG. 4 and FIG. 5, the body (2) comprises two opposing mirror faces which fit together and contain a chamber (9). The chamber can be of any shape, size, material, features, type or kind, orientation, location, quantity, components, and arrangements of components that would allow it to fulfill the objectives and intents of the invention. However, it can be preferred that the chamber be of a shape similar to the shape of the body.

Figure 2A:
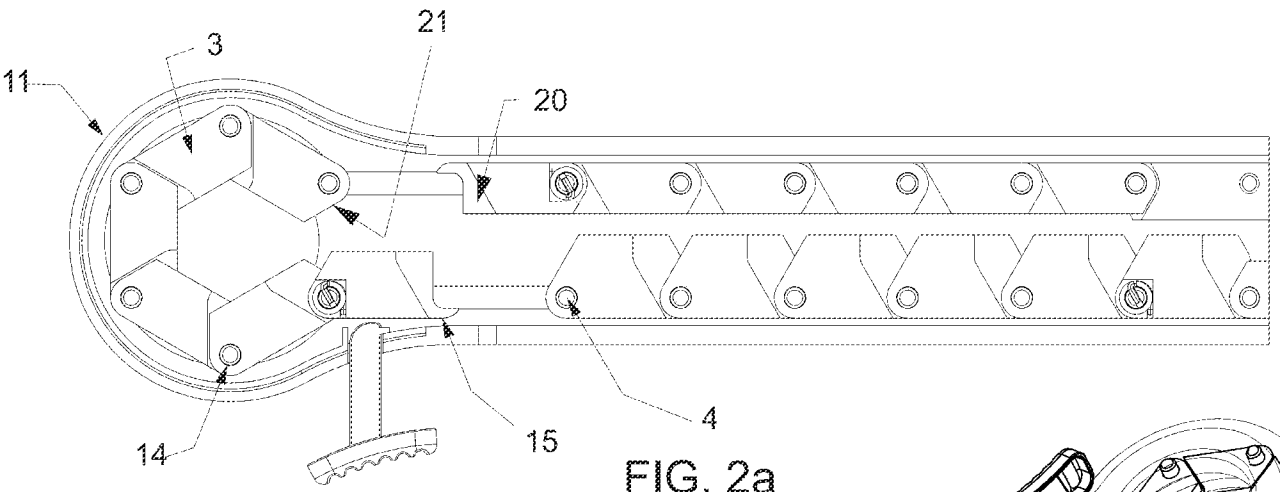
FIG. 2*a* is a cross-sectional, top plane view of a box end of a first embodiment of the invention with a set of links detached from the plurality of sets of links and in the open position.
Figure 2B:
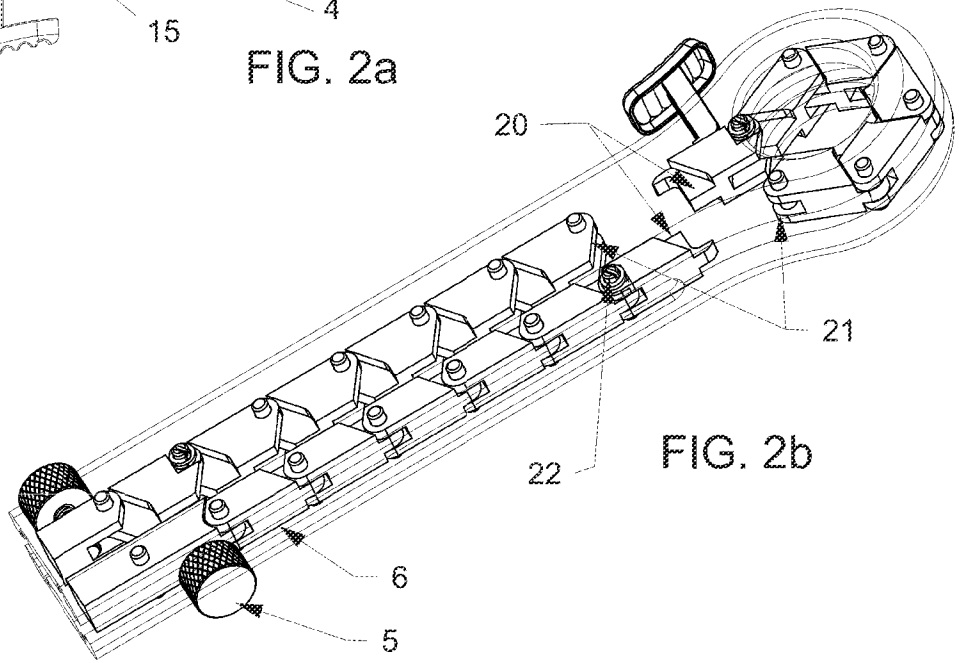
FIG. 2*b* is a cross-sectional, perspective view of a box end of a first embodiment of the invention with a set of links detached from the plurality of sets of links and in the open position.
Figure 3:
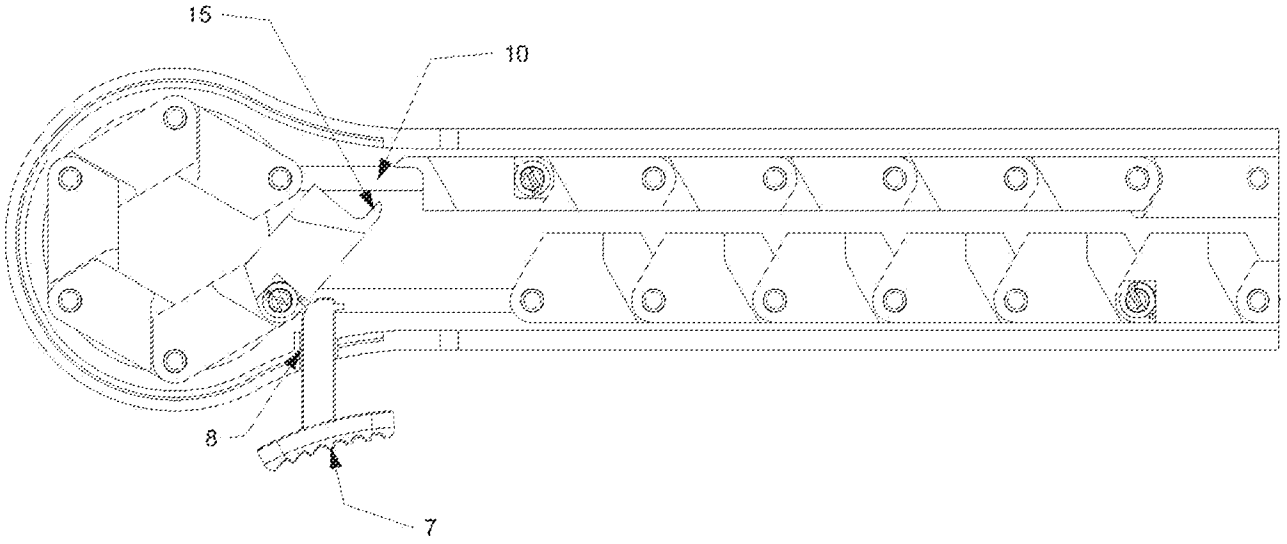
FIG. 3 is a cross-sectional, top plane view of a box end of a first embodiment of the invention with the switch pushed in to force the last link from one set of links to move toward the first link of said set of links.

As seen in FIG. 2 through FIG. 4, on the interior side of each of the mirror faces of the body are a first (10) and a second track (not shown) running around the perimeter of the body, with the first located on the inner surface of the top face of the chamber and the second on the inner surface of the bottom face of the chamber. In some embodiments each track may be formed by two or more discontiguous segments, or a different number of tracks may be placed in different locations to guide the loop as required within the particular embodiment. The track can be of any shape, size, material, features, type or kind, orientation, location, quantity, components, and arrangements of components that would allow it to fulfill the objectives and intents of the invention. It can be preferred that each track by of a general shape similar to the perimeter of the body and of an overall size slightly lesser than the overall size of the chamber. It can be preferred that each track be of a general height lesser than the overall height of a pin (4). It can be preferred that each track contain a gap width such that a bottom end of a pin from a set of links of a plurality of links can fit within the track while still having maneuverability to slide or glide along within the track. It can be preferred that the inner surfaces of the track be of a feature such that an end of a pin can glide within the track. Each track is generally identical and a mirror image of the other, but in certain embodiments each track may trace a different path and in certain embodiments pins may not be linear.

As seen in FIG. 1 through FIG. 5, the body contains one or more box ends (11), and a handle (12). Each box end can be of any shape, size, material, features, type or kind, orientation, location, quantity, components, and arrangements of components that would allow it to fulfill the objectives and intents of the invention. However, it can be preferred that each box end be of a material similar to and/or compatible with the material of the body. It can be preferred a first box be located at an end of the body next to an end of the handle and opposite from a second box end. It can be preferred that each box end be of an overall shape similar to a circular-like shaped figure. It can be preferred that each box end be of an overall diameter slightly larger than the width of the handle while being significantly smaller than the length of the handle. Between each box end is a handle (12). It can be preferred that the handle be of a width slightly lesser than the overall width of the body. It can be preferred that the handle be of a length larger than the width of the handle, while being of a length slightly lesser than the overall length of the body. It can be preferred that the handle be of an overall height similar to the height of the body. It can be preferred that the handle be located between the box ends of the body.

As seen in FIG. 5 each box end (11) of each of the mirror faces of the body can contain a hollow (13) in which the plurality of sets of links are recessed and through which a nut or bolt may be interfaced. The hollow can be of any shape, size, material, features, type or kind, orientation, location, quantity, components, and arrangements of components that would allow it to fulfill the objectives and intents of the invention. However, it can be preferred that one hollow be located on the top face of each box end, while a second hollow is located on the bottom face of each box end. It can be preferred that each hollow be of a diameter that is slightly lesser than the overall diameter of each box end. It can be preferred that each hollow be of a depth similar to the height of each box end.

As seen in FIG. 1 through FIG. 4, the invention contains a plurality of sets of links (3) which can differ from other sets of links in shape and/or size. Each set of links contains a series of links each identical in shape and/or size except the last link in the series, which is altered only at the trailing edge by a protruding knuckle (15). The links in a series are joined together by pins (4) inserted through a hole (14) at each link's termini. Each link within a set of links is connected to one another by a pin, although the last two links within a set are connected together by a spring-loaded pin 22) which facilitates detachment of each set of links from the others within the plurality. The pins project from the surface of each link and fit within the tracks (10) on the inner faces of the body, so as the guide the plurality of links within the chamber (9). Additionally, each set of links is detached from each other.

Both the individual links and the plurality of sets of links can be of any shape, size, material, features, type or kind, orientation, location, quantity, components, and arrangements of components that would allow it to fulfill the objectives and intents of the invention. However, it can be preferred that the plurality of sets of links be of a material that is similar and/or compatible with the material of the invention. It can be preferred that the plurality of sets of links be of a quantity similar to six; however, other quantities can be utilized with little to no modification to the invention and/or dependent on the shape of the head of the fastener or similarly related object. It can be preferred that each set of links within the plurality of sets of links be of similar shapes and/or sizes; however, it can be preferred that each set of links within the plurality of sets of links be differing widths. In other words, each set of links within the plurality of sets of links sequentially increase in width, while maintaining length and overall shape, as seen in FIG. 1. It can be preferred that the medial-facing surface of the plurality of sets of links be of a shape such that when a set of links is formed together within any box end, the medial-facing surfaces of that said set of links will form a shape similar to the shape of the head of a fastener or similarly related object. It can be preferred that said medial facing surfaces be positioned within the hollow (13) to facilitate easy interface between the nut and gripping surface in the box end. In some embodiments the medial facing surfaces of the links within each set of links may be differently faceted or shaped to form any shaped gripping surface required depending on the specific application of the wrench. It can be preferred that the plurality of sets of links be located within the chamber of the body between the first track and the second track such that the plurality of sets of links can be glided or transported rotatably through the chamber of the body.

As seen in FIG. 2*a* and FIG. 2*b*, the plurality of sets of links contains a first set of links (3) with all material, features, arrangements and components that would allow them to fulfill the objectives and intents of the invention. It can be preferred that each set of links contain links of a quantity equivalent to six, although any number may be employed as needed. In this Example the first link through fifth link are identical to each other in shape, size, material, features, type or kind, orientation, location, quantity, components, and arrangements of components. Each link has a tongue (20) at the trailing end, and a groove (21) at the leading end, such that the groove of each link may accommodate the tongue of the opposing link as the links of the series fold onto each other within the box end (11). The abutment of the opposing angled faces provides strength to the gripping interface. The last link in the series is identical to the rest in the series, except that it lacks a hole at its trailing end, which is instead modified by the addition of a knuckle (15) protruding from the link's trailing tongue. It can be preferred that each link within the first set of links be orientated and facing in the same direction. It can be preferred that each set of links contain a first link through a sixth link and a first pin through a sixth pin.

As seen in FIG. 2*a* and FIG. 2*b*, each link within a series contains at each end a hole (14) into which can be fitted a pin (4), except that the last in the series has no hole at the trailing end and instead has a knuckle (15) formed into its tongue (20). The hole, pin and knuckle can be of any shape, size, material, features, type or kind, orientation, location, quantity, components, and arrangements of components that would allow them to fulfill the objectives and intents of the invention. However, it can be preferred that the hole be of shape and size similar to the shape and size of each pin, allowing for the midsections of each pin to be held within the hole. It can be preferred that each link within the first set of links are hingedly-attached from end to another end in sequential order by aligning the hole of one link with the hole of the link that precedes it.

It is preferred that the top ends of the pins be located within the cavity of the first track and the bottom ends of the pins be located within cavity of the second track. However, it is preferred that the pin which is inserted into the holes connecting the last two links in a series, those most adjacent to the slide-switch, be of a type or kind and/or features related to a spring-loaded pin. It can be preferred that this spring-loaded pin be of a type or kind and/or of a feature such that when the first set of links is within a box end adjacent to the slide-switch, the free end of the last link in the series, and is most adjacent to the slide-switch, can be forced to rotate towards the free end of the first link in the series, and which is furthest and opposite from the slide-switch, in order for the medial-facing surfaces of the first set of links to form a shape similar to the shape of the face of a nut, bolt, or other similar objects as shown in FIG. 4. When slide-switch is released to its original open position, the free end of the link containing the spring-loaded pin is released back to the open position, FIG. 2*a*. In addition to the spring-loaded pin, the last link in a series is modified from the rest of those within the series, in that the hole and pin in the trailing tongue is absent and instead replaced by a knuckle (15) as shown in FIG. 2*a*. The knuckle is formed so as to rest behind the pin (4) at the leading edge of the next set of links, and so provide a strong yet detachable connection between each set of links within the plurality when in the open position within the handle (12). When in the closed position, the knuckle rests against the first pin of the leading link within the series, providing strength to the gripping interface as shown in FIG. 3 and FIG. 4.

As seen in FIG. 1 through FIG. 4, the plurality of sets of links contains two or more sets of links with similar features to the first set of links described above, and it can be preferred that the remaining set of links be identical to the first set of links in general shape, general size, material, features, type or kind, orientation, location, quantity, components, and arrangements of components. However, it should be noted that it is preferred, from the first through the remaining sets of links, that the links within a set of links vary in width with each sequential set of links, as illustrated in FIG. 1 through FIG. 4. Meaning, for instance, links within the second set of links can be of a greater width than the links within the first set of links; and sequentially onwards from the first set of links through the remaining sets. Although links within each set of the links are connected by means of pins, as described previously, each set of links is detached and not connected to each other.

As seen in FIG. 3, the body may contain one or more slide-switches (7) and one or more accompanying channels (8). The slide-switch moves within the channel and serves to actuate the sets of links adjacent to the box ends. The slide-switch and channel can be of any shape, size, material, features, type or kind, orientation, location, quantity, components, and arrangements of components that would allow them to fulfill the objectives and intents of the invention. However, it can be preferred that the slide-switch can be of a material similar to and/or compatible with the material of the invention. It can be preferred that the slide-switch be located at or within the channel in the handle of the body. It can be preferred that just the inner/medial stem-portion of the slide-switch be located within the channel in the handle, while the gripping/non-slipping surface of the slide switch be located on the outside of the handle of the body. The slide-switch and channel are usually located on the front face of the handle near to an end of the handle such that as the slide-switch is passing through the channel, the slide-switch can interface with a link of a set of links from a plurality of sets of links in order to push said link to close said set of links from the plurality of sets of links. It can be preferred that the channel be of a depth that does not exceed the distance to the opposing face of the handle from the face of the handle that contains the channel. In some embodiments the spring-pin is omitted and slide switch and/or the final link is magnetized to facilitate movement of the last link within the box end. In some embodiments an outward facing protrusion is added to the last link enabling the user to actuate the link to the closed position by pressing thereon.

Figure 6:
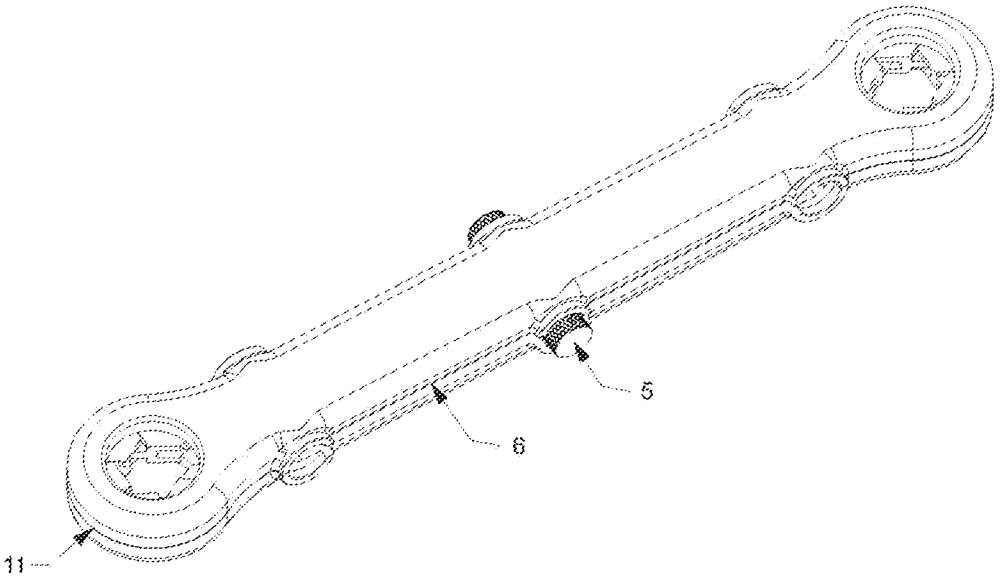
FIG. 6 is a perspective view of an alternative embodiment of the invention.

As seen in FIG. 1 and FIG. 6, the body may contain one or more slits (6) through which one or more scroll knobs (5) may travel so as to control movement of the links within the body of the invention. The scroll knobs and slits can be of any shape, size, material, features, type or kind, orientation, location, quantity, components, and arrangements of components that would allow them to fulfill the objectives and intents of the invention. It can be preferred that the slit be of cylindrical shape and of a general diameter such that a scroll knob can be fitted or inserted into and move within the slit. It can be preferred that the slit be of a depth similar to the width of the handle. It can be preferred that the scroll knobs be of a type or kind such that it can interface with the plurality of sets of links (3) in order to allow the plurality of set of links to transverse around within the chamber of the body (2). The invention may additionally contain a second slit and a second scroll knob, and such second scroll knob may optionally be located at the opposite side of the body from the first scroll knob, as demonstrated in FIG. 6. In some embodiments the links may be moved within the chamber using a ratchet or other appropriate system.

Example 2

Figure 7:
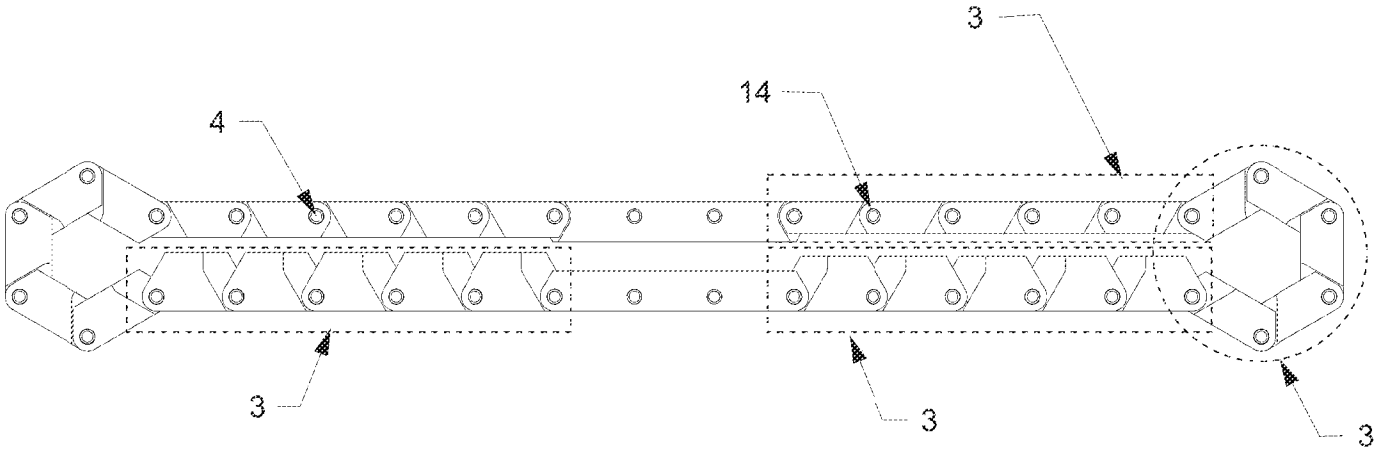
FIG. 7 is a top plane view the links of said alternative embodiment of the invention.
Figure 8:
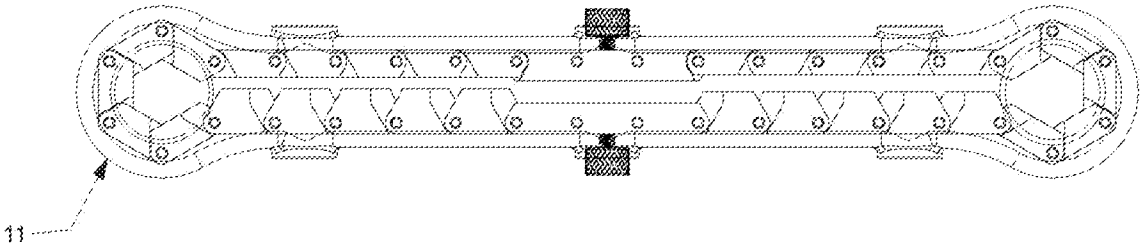
FIG. 8 is another top plane view of said alternative embodiment of the invention.

Example 2 shows an alternative embodiment of the invention, as illustrated in the drawings of FIG. 6 through FIG. 8. In this embodiment each set of links (3) within the plurality may differ from each other as in Example 1, but unlike the modified last link of Example 1, in this embodiment each link within each set of links is identical to the others in that set, lacking both the knuckle and spring-loaded pin of Example 1. Each link, and each set of links within the plurality of sets of links, are connected to each other by a pin (4) which sits in a hole (14) at each end of each link. As such the links form a continuous loop, and are formed into a gripping surface when curved within the box ends (11). Thus, in this alternative embodiment the invention does not contain a slide-switch. Additionally, in this embodiment, each set of links contain five links, which are used to form the gripping surface within a box end. It can be preferred that the plurality of sets of links contain five sets of links; however, other quantities can be utilized with little to no modification to the invention and will depend on the shape of the head of the fastener.

Example 3

Figure 9:
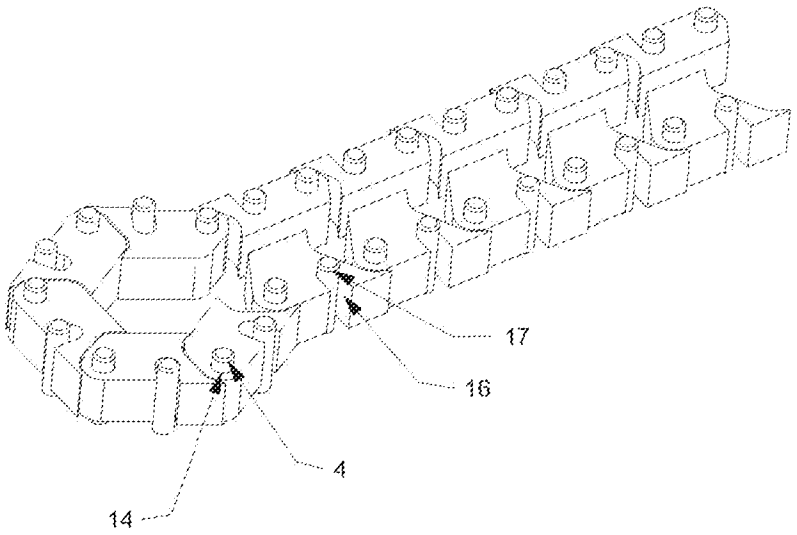
FIG. 9 is a cross-sectional, perspective view of the links and pins of another alternative embodiment of the invention.
Figure 10:
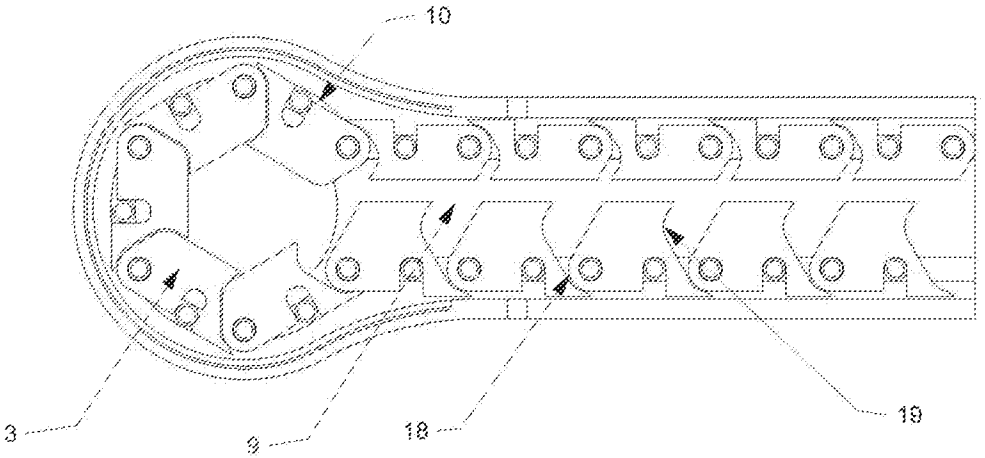
FIG. 10 is a cross-sectional, top plane view of a box end of this said alternative embodiment of the invention.
Figure 11:
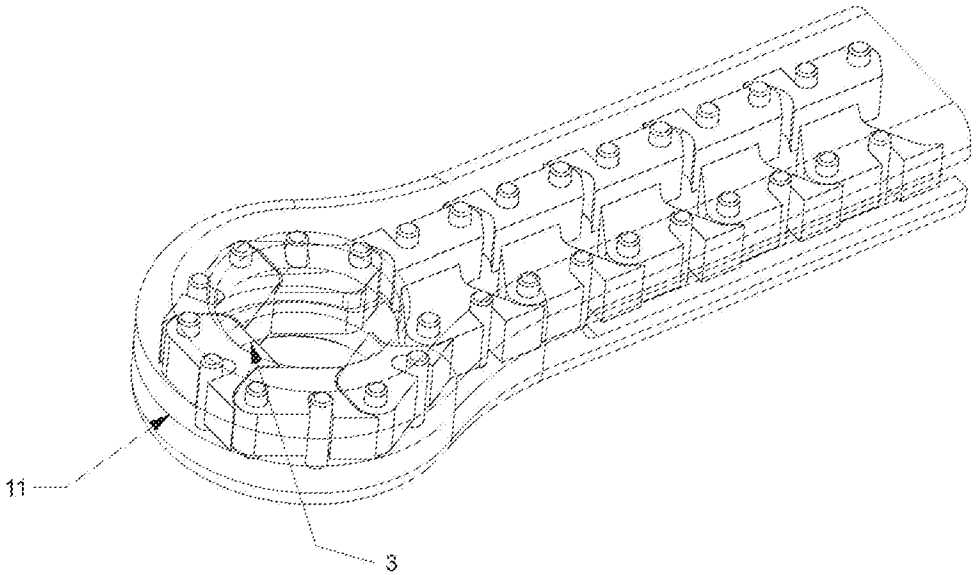
FIG. 11 is a cross-sectional, perspective view of a box end of this said alternative embodiment of the invention.

Example 3 shows an alternative embodiment of the invention, as illustrated in the drawings of FIG. 9 through FIG. 11. In this embodiment, each link, within the plurality of sets of links, is not interlocked or interfaced within each other, as seen in the previous Examples. Instead, each link in the plurality of sets of links are placed end to end to form a loop, with each link having a convex leading end (18) and a concave trailing end (19) along the axis of the loop. Each end can be of any shape, size, material, features, type or kind, orientation, location, quantity, components, and arrangements of components that would allow them to fulfill the objectives and intents of the invention. However, it can be preferred that the concave end is located at the trailing end of the link most adjacent to the slot hole, while the convex end be located on the surface of the link on the leading end of each link, and is formed such that it mirrors the concave feature of the opposing link so as to ensure that the set of links (3) when folded within the box end (11) can form a shape that resembles the shape of a face of a nut, bolt, or other similar objects as shown in FIG. 11.

In this Example each link contains both a hole (14) and a pin (4) at the convex leading end, as well as a slot-hole (16) and floating-pin (17) adjacent to the trailing concave end, and located on the perimeter or edge of the top plane surface of the links opposite across said surface from said hole (14). While a pin is affixed to the hole of the link, a floating-pin is located at the slot-holes, as seen in FIG. 9 and in FIG. 10. As with the previous Examples, the plurality of sets of links are arranged within a chamber (9) formed by matching body parts. However the links are not joined by the pins, rather guided within the channel (10) by the pins and floating pins whose alignment is controlled by the holes and slot-holes which allow the loop flexibility as it moves into the box end (11). This Example may optionally contain a scroll knob and slit to aid in movement of the loop.

Example 4

The invention can contain many further alternative embodiments. In one such alternative embodiment, the invention can be customized for implementation with a mechanical actuator, a robotic arm or within other specialized tools for industrial manufacturing processes or consumer applications. In such applications special regards can be given to choices and variance of different sizes and/or shapes of interface with the object to be gripped within the box end. Mechanical embodiments may also employ multiple handles within the body such that multiple box ends can be present on a single instance of the invention, and these box ends can be placed in any plane or location which best optimizes function in the device. In such embodiments the body of the wrench may have multiple projections and be angled such that box ends are perpendicular to each other and multiple box ends may be employed. Multiple instances of the invention may be present in a single device.

Another alternative embodiment of the invention can include a plurality of sets of links, in which the sequential sets of links do not different markedly from one another in width. Instead the sequential sets of links can differ from each other in how the medial-facing surfaces of the links form together to generate a shape within the empty cavity of the hole of a box end. In this alternative embodiment, each sequential set of links can be near similar in general size to each other; however, the overall shape of the links within one set of links from the plurality of sets of links may different from the overall shape of the links of another set of links within the plurality of the sets of links. Thus, in this alternative embodiment of the invention, the intended effect would be to have an adjustable box wrench that is adjustable to different and multiples of bolts, nuts, other similar object, and/or any combination of those aforementioned items; possible all of a similar or different size or gauge.

In another alternative embodiment of the invention the tracks are omitted from the opposing interior body faces and instead a single track runs around the interior of the side of the body where the two body parts meet. In this embodiment the pins joining the links no longer protrude from the links, but instead a third pin is attached to the exterior facing side of each link and sits within the single track to align the loop within chamber. Any combination of tracks and pins may be utilized, and all embodiments which utilize a series of pins and tracks to guide a plurality of sets of links within the chamber is envisaged within the scope of this embodiment.

Although the invention has been explained in relation to its preferred embodiments, it is to be understood that many other possible modifications and variations can be made without departing from the spirit and scope of the invention.

It is understood that the figures, examples and embodiments described herein are for illustrative purposes only and that various modifications or changes in light thereof will be suggested to persons skilled in the art and are to be included within the spirit and purview of this application and the scope of the appended claims. All publications, patents, and patent applications cited herein are hereby incorporated by reference in their entirety for all purposes.

We claim:

1. A box wrench having a body comprising at least one handle and at least one box head formed from two opposing sides each having an internal guide track, surrounding and encasing, a plurality of sets of links formed into a loop, each set of links comprises individual identical links each having a medial-facing surface for gripping a workpiece, wherein the medial-facing surface of each set of links is different in size from the medial-facing surface of an adjacent set of links and comprising three or more identical links with a hole and a groove at a leading end, and a hole and a tongue at a trailing end, said groove accommodating said tongue of the opposing link, and a set of pins each longer than the height of said links and fitting into the holes therein, and protruding into and moving within said guide tracks so as to position a medial-facing surface of said set of links into a gripping surface within said box end.

2. The invention of claim 1, further comprising a means for moving said plurality of sets of links within said body.

3. The invention of claim 2, wherein said means comprises at least one scroll knob and at least one slit.

4. The invention of claim 1 wherein a last link in each said set of links has a tongue with no hole and a protruding knuckle, and said pin is a spring-loaded pin, and further comprising at least one slide switch and at least one channel set in said body capable of actuating to close said last link into a gripping surface within said box end.

5. The invention of claim 1 wherein the number and positioning of said handles and said box ends are optimized for use in a robotic or mechanical application.

6. A box wrench having a body comprising at least one handle and at least one box head formed from two opposing sides each having an internal guide track, surrounding and encasing, a plurality of sets of links formed into a loop, each set of links comprises individual identical links each having a medial-facing surface for gripping a workpiece, wherein the medial-facing surface of each set of links is different in length from the medial-facing surface of an adjacent set of links and each set of links has a width that is different from the width of an adjacent set of links and comprising three or more identical links each having a convex leading edge including a hole and a concave trailing end, said concave end accommodating said convex edge of an opposing link, and one or more slot holes positioned on an outer face of each link, and a set of pins each longer than the height of said links and fitting fixedly into said holes and floating within said slot holes, and protruding into and moving within said guide tracks so as to position a medial-facing surface of said set of links into a gripping surface within said box end.

7. The invention of claim 6 wherein the number and positioning of said handles and said box ends are optimized for use in a robotic or mechanical application.

* * * * *